United States Patent [19]

Gentry

[11] 4,448,678

[45] May 15, 1984

[54] APPARATUS AND METHOD FOR BENEFICIATION OF LIGNITE

[75] Inventor: Cecil C. Gentry, Bartlesville, Okla.

[73] Assignee: Phillips Petroleum Company, Bartlesville, Okla.

[21] Appl. No.: 364,585

[22] Filed: Apr. 2, 1982

[51] Int. Cl.[3] ..... B03B 1/00; C22B 3/02

[52] U.S. Cl. ..... 209/3; 209/464; 241/260.1

[58] Field of Search ..... 209/18, 450, 463, 464, 209/3; 366/319, 320; 241/260.1

[56] References Cited

U.S. PATENT DOCUMENTS

| | | | |
|---|---|---|---|
| 254,505 | 3/1882 | Rollins | 209/464 |
| 292,550 | 1/1984 | Fairly . | |
| 439,905 | 11/1890 | Smith . | |
| 650,495 | 5/1900 | Spencer . | |
| 910,279 | 1/1909 | Freygang . | |
| 992,629 | 5/1911 | Akins . | |
| 1,298,577 | 3/1919 | Sawyer et al. | 209/464 |
| 1,412,010 | 4/1922 | Akins . | |
| 1,609,652 | 12/1926 | McQueen . | |
| 1,785,302 | 12/1930 | Dickson . | |
| 2,032,338 | 2/1936 | Anderson | 83/52 |
| 2,216,371 | 10/1940 | Leveke | 209/464 |
| 2,452,249 | 10/1948 | Leiske | 34/183 |
| 2,531,928 | 11/1950 | Webb | 198/64 |
| 2,621,791 | 12/1952 | Bitzer | 209/464 |
| 3,385,432 | 5/1968 | Overall et al. | 209/18 |
| 3,451,566 | 6/1969 | Hanson | 214/17 |
| 3,702,128 | 11/1972 | Trotter | 198/64 |
| 3,737,032 | 6/1973 | Burkitt | 209/10 |
| 3,739,911 | 6/1973 | Patch | 209/460 |
| 4,039,169 | 8/1977 | Bartholomen | 366/319 |

*Primary Examiner*—David L. Lacey

[57] ABSTRACT

In an apparatus and its method of use in which lignite is moved upwardly in an inclined trough by a screw conveyer-agitator and fractured and washed while being so moved and when washed being removed from the upper end of said trough and wherein the lower end of the trough is arranged to provide a section in which a quiescent phase of liquid is formed to allow any suspended lignite to settle therefrom while a supernatant phase containing mineral matter suspended therein is removed the improvement which consists of having a two-section conveyor screw the lower-end portion or length thereof exposed in or by said quiescent phase being structured with a smooth flight or blade which can be rotated without disturbing unduly the supernatant phase thus to avoid suspending lignite therein while the remaining length of the screw conveyor can be structured to impact and fracture the crushed lignite while it is being agitated in the presence of a washing medium.

3 Claims, 5 Drawing Figures

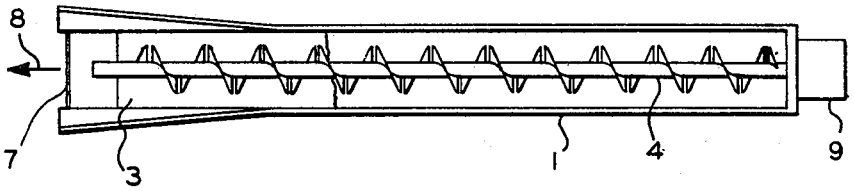
FIG. 1
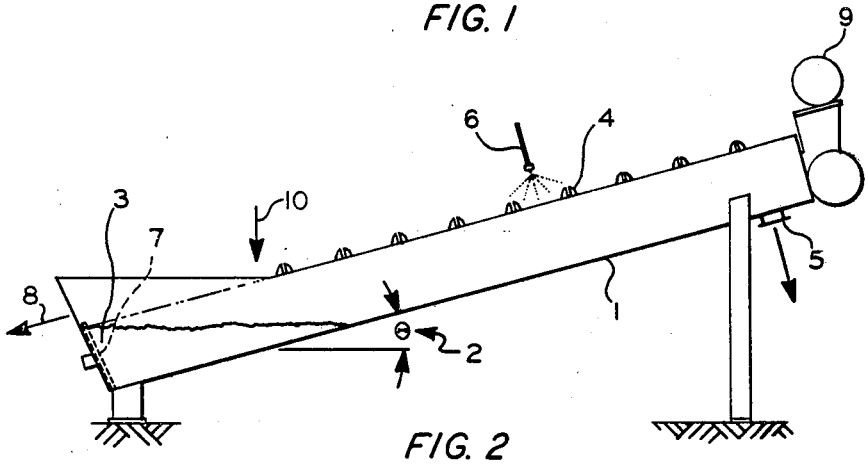
FIG. 2
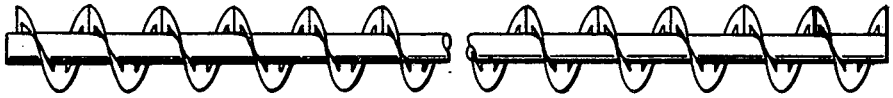
PRIOR ART FIG. 3
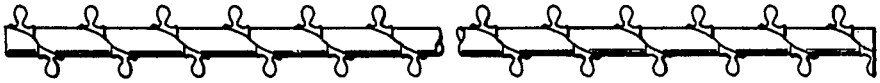
PRIOR ART FIG. 4
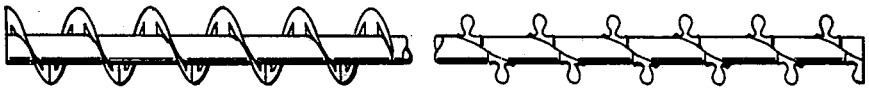
FIG. 5

APPARATUS AND METHOD FOR BENEFICIATION OF LIGNITE

BACKGROUND OF THE INVENTION

This invention relates to the beneficiation of lignite. In one of its aspects it relates to the recovery of lignite having a substantially reduced mineral matter or ash content. In another of its aspects the invention relates to a specially designed apparatus for beneficiating lignite.

In one of its concepts the invention provides a method for beneficiating lignite by removing therefrom clay or other mineral matter which comprises crushing a lignite, introducing the crushed lignite into an upwardly inclined conveyor-agitator-washing zone, conveying it upwardly through the zone while agitating, and bringing the lignite into intimate contact with a washing or cleaning medium e.g., water, under agitating conditions sufficient to fracture the lignite; allowing cleaning medium to move downwardly through said zone, maintaining a relatively quiescent section at the lower end portion of the zone, allowing lignite to settle to the bottom of the quiescent section, removing lignite from the bottom of the quiescent section without disturbing unduly its quiescent state, conveying the removed lignite upwardly through the zone and removing supernatant washing medium containing undesired impurities suspended therein from the bottom portion of the zone while removing cleaned lignite from the upper end of the zone. In a more specific concept of the invention it provides a smooth flight or blade equipped screw portion extending through the quiescent zone and a notched or otherwise structured agitator-conveyor portion on the remainder of the screw, as further described below.

The art of conveyors, washers and apparatus for removing water from ores and for removing shale and coal from gravel is replete with a great many different and many similar disclosures of methods and apparatus. U.S. Pat. No. 992,629 issued May 16, 1911, shows an apparatus for dewatering and classifying ores in which rotation of a continuous spiral agitates a pulp and causes lighter particles of ore or slimes to be retained in suspension with the coarser particles settling through the liquid. Interrupted spiral flights or rabbles cause the heavier particles of ore which have settled to the bottom of a tank and which have been conveyed to the end of the continuous spiral, to be carried to a sand-delivery end with water and lighter particles draining back through the interrupted spirals.

U.S. Pat. No. 2,216,371 issued Oct. 1, 1940, for apparatus for removing shale, coal, and the like from gravel discloses an apparatus wherein at a lower end thereof water is passed upwardly into an agitating section and out the top of this section from which the introduced material is upwardly conveyed by a continuous flight. U.S. Pat. No. 3,739,911, issued June 19, 1973, discloses a pool-less auger-separator for material of differing specific gravities. The patent shows the moving of heavier substances upwardly with an auger in a trough while pieces of lighter substance which can be as large as lump coal are pushed by the force of turbulent, pool-less, free-flowing water out of an open lower end of the trough. U.S. Pat. No. 1,412,010, issued Apr. 4, 1922, for an ore classifier, shows on the same shaft a continuous spiral and spiral flights having rabbles or blades which serve to convey material toward a more elevated portion of the apparatus, agitating as each succeeding blade tends to have a plying effect upon the material left by the preceding blade while the liquid in the apparatus can drain freely back through and between the rabbles or interruped spirals. An overflow weir over which slime and lighter particles overflow is shown at the lower end.

In Ser. No. 364,586 filed of the same date herewith by Cecil C. Gentry and Henry E. Alquist and commonly assigned herewith there is disclosed and claimed a method for removing from lignite a substantial portion of mineral matter or ash content originally associated therewith which comprises feeding crushed lignite into a lower-end portion of an upwardly inclined conveyor treating zone, in this zone subjecting the lignite to agitation and consequent fracturing while simultaneously subjecting the lignite to the action of a cleaning or washing medium, removing treated lignite from an upper-end portion of the zone; permitting settling of lignite from the medium now containing ash-producing particles suspended therein, at the lower-end portion of the zone below the locus of introduction of the crushed lignite; conveying the lignite upwardly through the zone; and removing cleaning medium, now supernatant the lignite, from the lower-end portion of the zone.

Also disclosed and claimed in the copending application is an apparatus comprising in combination a conveyor section, a conveyor screw within this section, means for introducing into a lower-end portion of the apparatus a crushed material to be cleaned therein, means for causing the conveyor screw to convey crushed material upwardly through the apparatus, means at the upper-end of the apparatus for removing cleaned material herefrom, means associated with the apparatus for supplying a cleaning medium to the crushed material therein while it is being upwardly conveyed by the conveyor screw and agitated thereby, a quiescent section at a lower-end portion of the apparatus below the point of introduction of the material to be cleaned to permit settling of the cleaned material to provide a supernatant phase of cleaning medium and means for removing the supernatant phase from the apparatus.

I have now conceived that the separation in the quiescent section can be effectively accomplished while simultaneously providing considerably increased flexibility of operation in the fracturing and washing of the crushed lignite in the fracturing and washing section of the overall zone e.g., wider rotational speed limits, by providing means or operating methods for removing the settled lignite from the quiescent section by employing a screw conveyor sectioned as herein described.

An object of this invention is to beneficiate lignite. Another object of this invention is to provide a method for removing mineral matter or ash content from lignite. A further object of the invention is to provide a method for removing mineral matter from a lignite into a washing medium and recovering said washing medium from lignite without loss of the lignite into the washing medium while at the same time producing a lignite of substantially reduced mineral matter content.

Other aspects, concepts, objects, and the several advantages of this invention are apparent from a study of this disclosure, the drawings and the appended claims.

STATEMENT OF THE INVENTION

According to the present invention, crushed lignite is introduced to a locus along the length of an upwardly inclined conveyor-agitator, washing, or treatment zone and conveyed upwardly through the zone wherein it is agitated, fractured and washed, removing washed lignite from the upper end of the zone, allowing washings to flow downwardly through the zone to the lower-end portion thereof, maintaining quiescent conditions at the lower-end of the zone, allowing lignite in the washings to settle into the bottom of the end of the zone and moving settled lignite upwardly, as with a smooth blade or flight conveyor, from the bottom end of the zone while decanting or otherwise removing supernatant washing medium containing suspended therein the undesired impurities.

BRIEF DESCRIPTION OF THE DRAWINGS

FIG. 1 is a top-plan view of an apparatus suited to carry out the invention.

FIG. 2 is a side elevational view of that apparatus.

FIGS. 3 and 4 show a helical and a notched screw, respectively.

FIG. 5 shows a screw embodying the present invention.

It is important in the beneficiation of lignite herein described, and described in the copending application, the disclosure of which is incorporated herein by reference, for best results to determine the rotational speed as well as configuration of the agitator-conveyor portion of the screw which will best effect the desired treatment. By providing the two-section screw conveyor of FIG. 5 there is accomplished a flexibility of design as well as of operation not heretofore possible.

Referring now to the drawings, in FIGS. 1 and 2 there is shown an open trough 1 oriented at a positive inclination angle 2 with respect to the horizontal. At the lower end of the trough there is provided a large, settling pool 3 extending approximately ⅓ the total length of the trough. Mounted along the longitudinal axis of the inclined trough is a helical screw agitator 4 which, according to the invention, will have a configuration as shown in FIG. 5. Extending along the longitudinal axis of the inclined trough, from the upper region of the settling pool to near the lignite product discharge port 5 are water discharge sprayers 6. At the lower end of the settling pool is an adjustable-height weir 7 over which the waste tailings are passed as a stream 8. Rotation of the helical screw agitator 4 is produced by an electric motor-transmission assembly 9.

As can be seen from the drawings, and further understood from this description, the provision of the two-section screw makes it possible to agitate, to fracture and to clean the lignite in one portion of the trough while not disturbing the settling action taking place in the lower portion thereof.

Thus, beneficiation of the crushed lignite is accomplished by introducing previously crushed lignite 10 into the inclined trough at an axial location approximately at the upstream end of the settling pool 3. Rotation of the screw 4 imparts sufficient impact force on the crushed lignite to cause fracture along maceral boundaries, thereby exposing seam and surface ash deposits. The speed of rotation of the helical screw, having two sections according to the present invention, should be of sufficient magnitude to accomplish fracture without being high enough, because of its two-section structure, to create undesired turbulence in the settling pool 3. Thus, according to the invention, the rotation of the helical screw and the jet action of the water sprayers, can advantageously produce sufficient inter-particle movement and scrubbing action to release seam and surface ash. The released ash settles to the bottom surface of the inclined trough 1 and is transported by the water stream in a counterflow direction relative to the cleaned lignite, downward to the settling pool. Within the settling pool larger but less dense lignite particles settle to the lower region of the settling pool while smaller (75% less than 270 mesh) more dense ash-forming particles (primarily silica and alumina) pass over the settling pool weir 7 along with the tailings water. The mechanism of particle settling is governed by a basic principle of fluid mechanics, i.e., Stokes Law. The size of the particles which are transported over the weir in tailings 8 is governed by the inter-relationship of weir height, inclination angle, rotation speed and configuration of the helical screw as well as the relative quantities of lignite feed and spray water. Paramount to successful wet separation of ash and lignite particles is the maintenance of the quiescent settling pool.

According to the present invention, the quiescent settling pool can be maintained albeit wider latitude of operational parameters is possible, as described herein.

RANGES OF DESIGN AND OPERATING PARAMETERS

| Parameter | Broad Range | Preferred Range |
|---|---|---|
| Precrushed lignite top size, inches | 0.25–2.0 | 0.75–1.25 |
| Ash Content (dry basis), percent | | 17–30 |
| Spray Water Flow, lb/min | | 10–40 |
| Lignite Feed Rate, lb/min | | 6–25 |
| Lignite to Water Feed Ratio, lb/lb | 0.61–2.12 | 0.7–0.75 |
| Screw Diameter (pilot plant scale), inches | | 6 |
| Screw Length (pilot plant scale), feet | | 6 |
| Screw Pitch, inches | | 6 |
| Trough Angle, degrees from horizontal | 5–20 | 10 |
| Speed of Rotation, rpm | 10–50 | 20 |
| Overflow Weir Height, inches | | 5–12 |

The above given ranges of variables apply to the use of a pilot plant model for this method. Where applicable these ranges will necessarily be scaled up for full size commercial use with comparable beneficiation.

EXAMPLES

A series of experimental runs was made using a pilot plant scale logwasher with a 6-foot long, 6-inch diameter, 6-pitch screw. Runs were made with a screw notched along its entire length and also with the two-section screw of this invention.

The lignite was a high-ash, precrushed, run-of-mine feed. The variables investigated were type screw, rotational speed, angle of inclination, feed size, water and lignite feed rates, initial ash, and the effect of all these upon ash content of the product lignite.

The data in Table I include five runs made according to the invention of the copending case above identified. The remaining runs are runs according to the present invention employing the two-section screw.

As can be seen from Table I, when comparing runs 1–5 with runs 6–10, which are according to the invention, markedly better results were obtained with the invention. Thus, viewing the "Feed Recovered" column and comparing the trends of runs 1–3 and of runs 6–10, it is seen that better recovery is obtained with the invention. Further, as seen from runs 9 and 10, the higher rpm obtainable with the invention permits considerably reduced water consumption.

Viewing Table II it will be seen that regardless of the percentage reduction of ash, the product, i.e., the treated lignite, has a considerably increased heating valve.

TABLE I

| Run | Screw | RPM | Angle (deg) | Lignite Top Size | Lignite Feed lb/min. | Water Flow lb/min. | Lignite To Water Feed Ratio | Dry Basis Initial Ash | Dry Basis Cleaned Ash | Dry Basis Feed Recovered |
|---|---|---|---|---|---|---|---|---|---|---|
| | | | | Lignite Beneficiation Results | | | | | | |
| 1 | Ribbon | 20 | 14 | 1" | 25.0 | 11.8 | 2.12 | 21.0% | 15.8% | 94.7% |
| 2 | Notched | 20 | 10 | 1" | 7.11 | 10.0 | 0.71 | 26.1% | 19.7% | 90.1% |
| 3 | Notched | 20 | 10 | 1" | 6.77 | 10.0 | 0.68 | 22.0% | 14.2% | 93.9% |
| 4 | Notched | 20 | 10 | ¾" | 6.07 | 10.0 | 0.61 | 20.6% | 16.0% | 92.1% |
| 5 | Notched | 20 | 10 | ¼" | 6.67 | 10.0 | 0.67 | 17.9% | 15.1% | 87.5% |
| | | | | Data for Runs using a Combination Two-Section Screw | | | | | | |
| 6 | Two Section | 20 | 10 | 1"-1¼" | 7.0 | 10.0 | 0.7 | 17.2 | 15.2 | 97.6 |
| 7 | Two Section | 25 | 10 | 1"-1¼" | 7.0 | 10.0 | 0.7 | 20.1 | 18.3 | 94.1 |
| 8 | Two Section | 45 | 10 | 1"-1¼" | 7.0 | 10.0 | 0.7 | 26.0 | 18.7 | 89.8 |
| 9 | Two Section | 45 | 10 | 1"-1¼" | 7.0 | 5.0 | 1.4 | 24.3 | 16.8 | 94.9 |
| 10 | Two Section | 45 | 10 | 1"-1¼" | 7.0 | 2.5 | 2.8 | 21.5 | 16.2 | 91.2 |

TABLE II

| Run | Initial Btu/lb. | % Feed Recovered | Product Btu/lb. | % Heating Valve Recovered |
|---|---|---|---|---|
| | | Heating Valve Determinations - Calculated | | |
| 1 | 6535. | 94.7 | 7032. | 101.9 |
| 2 | 6048. | 90.1 | 6659. | 99.2 |
| 3 | 6440. | 93.9 | 7185. | 104.8 |
| 4 | 6574. | 92.1 | 7013. | 98.3 |
| 5 | 6831. | 87.5 | 7099. | 90.9 |
| | Avg. 6486. | Avg. 91.7 | Avg. 6998. | Avg. 99.0 |
| | | Combination Two-Section Screw | | |
| 6 | 6898. | 97.6 | 7089. | 100.3 |
| 7 | 6621. | 94.1 | 6793. | 96.5 |
| 8 | 6088. | 89.8 | 6755. | 100.1 |
| 9 | 6220. | 94.9 | 6936. | 105.8 |
| 10 | 6488. | 91.2 | 6994. | 98.3 |
| | Avg. 6457. | Avg. 93.5 | Avg. 6913. | Avg. 100.2 |

Note:
The formula employed for the calculations reported in Table II is Btu/lb = [12560 − 140.44 × % ash] 0.68
The equation given was established based on several Panther Hill lignite samples. It was considered that the untreated lignite contained 32% $H_2O$. Hence the "0.68 factor".

The advantage of the two-section screw, used in Runs 6–10, over the single type of Runs 1–5 is indicated in the higher permissible rotational speeds of Runs 8–10. With the smooth helical ribbon in the settling zone and the notched screw above, high speeds are possible with some improvement in cleaning and less lignite lost in tailings while using less wash water.

Reasonable variation and modification are possible in the scope of the foregoing disclosure, the drawings, and the appended claims to the invention the essence of which is that in the operation described wherein crushed lignite is washed in an upwardly inclined conveyor-agitator-washer zone having a settling or quiescent section at the lower end thereof there have been provided two sections of the conveyor screw permitting wider flexibility of operation in the fracturing and washing section of the operation while maintaining quiescent conditions in the settling section provided.

I claim:

1. A method for beneficiating crushed lignite which comprises (1) feeding the same into a locus in a lower-end portion of a conveying-fracturing-washing zone disposed in an upwardly inclined direction and (2) conveying crushed lignite in said zone from the lower-most end of a quiescent section provided therein to the upper discharge end of said zone using a conveying means having two portions: (a) the portion of said conveying means extending within the quiescent section having a configuration to convey the lignite therefrom without causing turbulence of the supernatant liquid therein and (b) the portion of said conveying means extending through the remaining portion of said zone having a configuration to accomplish conveying, fracturing, and intimate mixing of the lignite with a washing medium to convey washed lignite up to a discharge at the upper end of said zone.

2. A method according to claim 1 wherein the zone is provided with an inclined trough equipped with said conveying means, said conveying means being a rotatable screw conveyor and the portion of said screw conveyor extending within the quiescent section being provided with a smooth helical blade and in the remaining portion of said zone said screw is provided with notched configuration means which agitates and fractures the lignite.

3. An apparatus for beneficiating crushed lignite which comprises in combination an inclined trough, a screw conveyor extending throughout a substantial length of said trough, means for supplying washing medium to said trough, a discharge for beneficiated lignite at the upper end of said trough and a discharge for washing medium fed to said trough at the lower end thereof, a settling section in the lower-end portion of said trough, means for feeding crushed lignite to a locus approximately at the upper end of a quiescent section defined by a pool of washing medium overflowing the lower end of said trough, said screw conveyor being composed of two sections, a first section extending within said quiescent section having a smooth helical blade and a second section disposed substantially outside said quiescent section having notched means positioned and arranged to agitate, fracture and intimately to admix the crushed lignite with said washing medium.

* * * * *